US012760914B2

(12) United States Patent
Wang et al.

(10) Patent No.: US 12,760,914 B2
(45) Date of Patent: Oct. 13, 2026

(54) AIR CONDITIONER PIPELINE AND AIR CONDITIONER

(71) Applicant: Gree Electric Appliances, Inc. of Zhuhai, Zhuhai (CN)

(72) Inventors: Jing Wang, Zhuhai (CN); Meng Huang, Zhuhai (CN)

(73) Assignee: Gree Electric Appliances, Inc. of Zhuhai, Zhuhai (CN)

( * ) Notice: Subject to any disclaimer, the term of this patent is extended or adjusted under 35 U.S.C. 154(b) by 346 days.

(21) Appl. No.: 18/273,590

(22) PCT Filed: Oct. 15, 2021

(86) PCT No.: PCT/CN2021/124180
§ 371 (c)(1),
(2) Date: Jul. 21, 2023

(87) PCT Pub. No.: WO2022/166253
PCT Pub. Date: Aug. 11, 2022

(65) Prior Publication Data

US 2024/0077216 A1 Mar. 7, 2024

(30) Foreign Application Priority Data

Feb. 3, 2021 (CN) ..... 202110149337.9

(51) Int. Cl.
*F24F 1/26* (2011.01)
*F25B 41/40* (2021.01)

(52) U.S. Cl.
CPC ..... *F24F 1/26* (2013.01); *F25B 41/40* (2021.01)

(58) Field of Classification Search
CPC ..... F16L 11/27; F16L 11/121; F16L 25/01; F16L 29/04; F16L 59/147; F24F 1/32; F24F 1/34; F24F 1/26
See application file for complete search history.

(56) References Cited

U.S. PATENT DOCUMENTS 409,182 A * 8/1889 De Ferranti ..... H02G 3/00 307/147
2,708,835 A * 5/1955 Nigro ..... F24F 1/022 62/448

(Continued)

FOREIGN PATENT DOCUMENTS

CN 101281801 A 10/2008
CN 102589052 A 7/2012

(Continued)

OTHER PUBLICATIONS

CN 202110149337.9, Notice of First Review Opinion, Jun. 1, 2024.
EP 21924250, Extended European Search Report, May 3, 2024.

*Primary Examiner* — Jianying C Atkisson
*Assistant Examiner* — Meraj A Shaikh
(74) *Attorney, Agent, or Firm* — The Webb Law Firm

(57) ABSTRACT

The present disclosure relates to an air conditioner pipeline and an air conditioner, thereby alleviating the problem of complicated installation of the air conditioner pipeline. The air conditioner pipeline includes a pipe body. A flow channel for a refrigerant to flow is formed by an inner side of a pipe wall of the pipe body. The pipe wall of the pipe body is provided with at least two conductive parts and insulating parts, where the conductive parts are configured to transmit power to the air conditioner, and the insulating parts are configured to realize insulation between the conductive parts. The air conditioner pipeline provided by the present disclosure can transmit refrigerants and also can transmit power, thereby saving the connection cost of an indoor unit and an outdoor unit of the air conditioner, reducing the installation complexity of the air conditioner, achieving high safety and facilitating implementation.

11 Claims, 1 Drawing Sheet

(56) References Cited

U.S. PATENT DOCUMENTS

| | | | | | |
|---|---|---|---|---|---|
| 5,484,300 | A * | 1/1996 | Whitney | H02G 5/061 | 439/210 |
| 5,920,032 | A * | 7/1999 | Aeschbacher | H01B 7/16 | 174/113 C |
| 9,959,954 | B1 * | 5/2018 | Jackson | H02G 3/0468 | |
| 2008/0083240 | A1 * | 4/2008 | Su | F24F 1/027 | 62/262 |

FOREIGN PATENT DOCUMENTS

| | | | | |
|---|---|---|---|---|
| CN | 102767922 | A | 11/2012 | |
| CN | 105526647 | A | 4/2016 | |
| CN | 106335250 | A | 1/2017 | |
| CN | 106440052 | A | 2/2017 | |
| CN | 209938255 | U | 1/2020 | |
| CN | 210107661 | U | 2/2020 | |
| CN | 111884682 | A | 11/2020 | |
| CN | 112747386 | A | 5/2021 | |
| CN | 112747387 | A | 5/2021 | |
| CN | 112747388 | A | 5/2021 | |
| CN | 215001946 | U | 12/2021 | |
| DE | 69521460 | T2 | 6/2002 | |
| DE | 102010034066 | A1 * | 2/2012 | F16L 11/127 |
| EP | 0695917 | B1 * | 6/2001 | F24F 1/32 |
| JP | H09269159 | A | 10/1997 | |
| KR | 1020060011137 | A | 2/2006 | |
| KR | 1020120055151 | A | 5/2012 | |

* cited by examiner

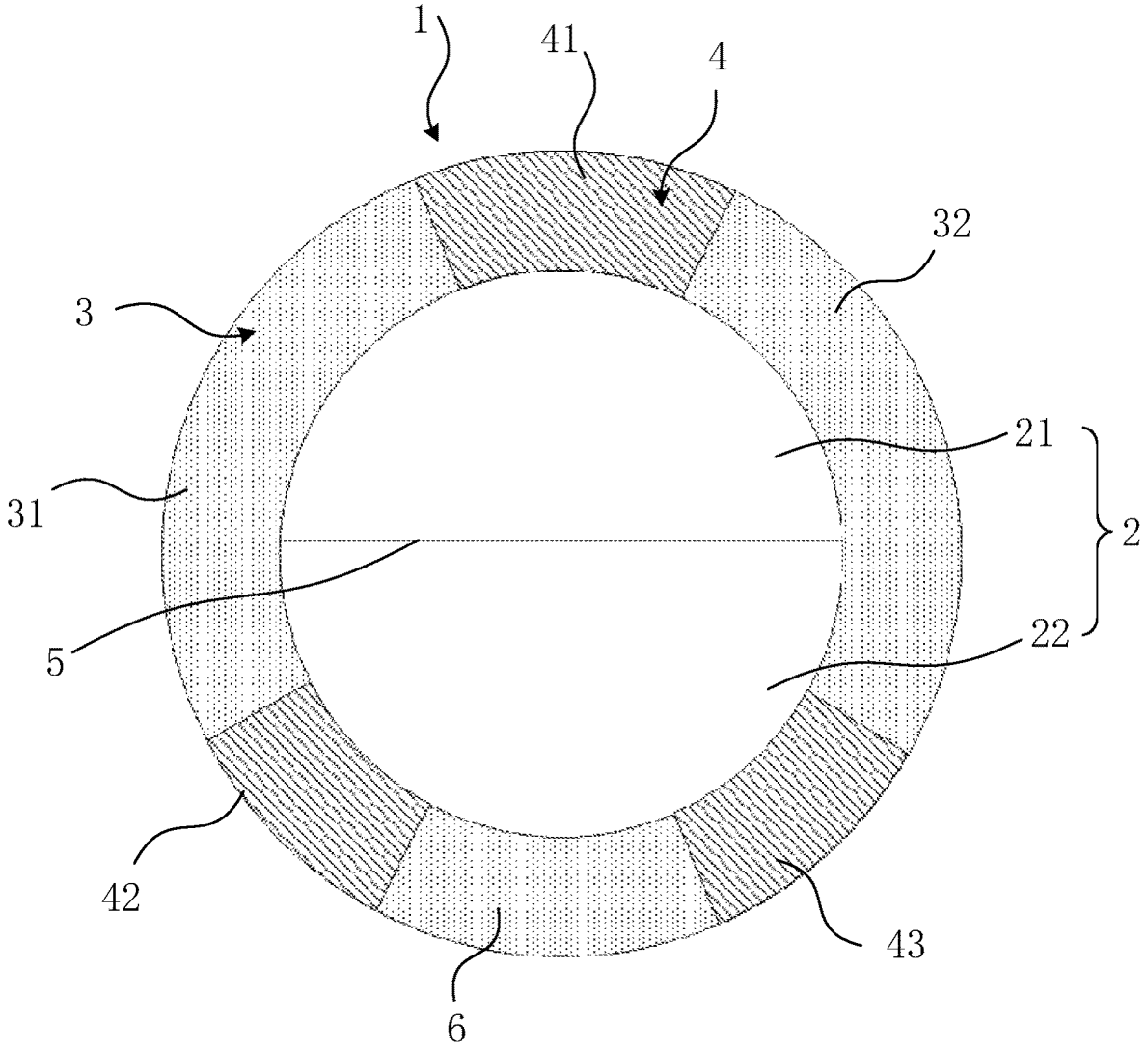
1
41
4
32
3
21
31
2
5
22
42
43
6

AIR CONDITIONER PIPELINE AND AIR CONDITIONER

CROSS-REFERENCE TO RELATED APPLICATIONS

This application is a U.S. National Stage Application of International Patent Application No. PCT/CN2021/124180, filed Oct. 15, 2021, and claims priority to Chinese Patent Application No. 202110149337.9, filed Feb. 3, 2021, the disclosures of which are hereby incorporated by reference in their entireties.

BACKGROUND OF THE INVENTION

Field of the Invention

The present disclosure relates to the field of air conditioner, and in particular, to an air conditioner pipeline and an air conditioner.

Description of Related Art

An indoor unit and an outdoor unit of a split air conditioner are separated. A copper pipe is used for refrigerant transmission, and a conducting wire is used for power supply and communication. Two different work requirements of pipe connection and wiring increase the complexity of tools and skills. If the copper pipe and a cable are wound together and a protective layer such as sponge is added to an outer layer, a diameter of a pipeline is large and inconvenient to install, and the use of the cable will cause great waste.

SUMMARY OF THE INVENTION

Some embodiments of the present disclosure provide an air conditioner pipeline, including a pipe body, wherein a flow channel for a refrigerant to flow is formed by an inner side of a pipe wall of the pipe body; the pipe wall of the pipe body is provided with at least two conductive parts and insulating parts; the conductive parts are configured to transmit power to the air conditioner; and the insulating parts are configured to realize insulation between the conductive parts.

In some embodiments, the air conditioner pipeline further includes a partition plate arranged on the inner side of the pipe wall of the pipe body and configured to at least partition the flow channel for the refrigerant to flow into a first flow channel and a second flow channel, wherein the first flow channel is configured to convey a liquid refrigerant, and the second flow channel is configured to convey a gaseous refrigerant.

In some embodiments, the conductive parts are made of metal conductive materials, and the conductive parts are configured as power transmission lines.

In some embodiments, the at least two conductive parts include a first conductive part and a second conductive part which surround a central axis of the pipe body at intervals; the insulating parts are arranged between the first conductive part and the second conductive part; the first conductive part and the second conductive part are made of metal conductive materials; and the first conductive part is configured as a live wire, and the second conductive part is configured as a neutral wire.

In some embodiments, the pipe wall of the pipe body is provided with a communication part; the communication part and the conductive parts surround the central axis of the pipe body at intervals; the insulating parts are further configured to realize insulation between the communication part and the conductive parts; and the communication part is configured as a communication transmission line to transmit a communication signal to the air conditioner.

In some embodiments, the communication part is made of a metal conductive material, and the communication part is configured as a communication transmission line.

In some embodiments, the conductive parts include the first conductive part and the second conductive part; the pipe wall of the pipe body is further provided with the communication part; the insulating parts include a first insulating part, a second insulating part and a third insulating part; the first insulating part is arranged between the first conductive part and the second conductive part; the second insulating part is arranged between the first conductive part and the communication part; and the third insulating part is arranged between the second conductive part and the communication part.

In some embodiments, the conductive parts are integrally extruded by the metal conductive materials, and the insulating parts are integrally extruded by insulating materials.

In some embodiments, materials of the conductive parts include copper.

In some embodiments, length extending directions of the conductive parts and the insulating parts are consistent with a length extending direction of the pipe body.

Some embodiments of the present disclosure provide an air conditioner, including the above air conditioner pipeline.

Based on the above technical solution, the present disclosure at least has the following beneficial effects:

in some embodiments, the inner side of the pipe wall of the pipe body is used for refrigerant transmission, the pipe wall of the pipe body is provided with the conductive parts, the conductive parts are configured to transmit power, and one air conditioner pipeline can transmit refrigerants and also can transmit power, thereby saving the connection cost of an indoor unit and an outdoor unit of the air conditioner, reducing the installation complexity of the air conditioner, achieving high safety and facilitating implementation.

BRIEF DESCRIPTION OF THE DRAWINGS

The accompanying drawings described herein are used to provide further understanding of the present disclosure and constitute a part of the present application. The schematic embodiments of the present disclosure and the description thereof are used to explain the present disclosure, but do not constitute an inappropriate limitation to the present disclosure. In the drawings:

FIG. 1 is a cross-section schematic diagram of an air conditioner pipeline according to some embodiments of the present disclosure.

DESCRIPTION OF THE INVENTION

The technical solutions in the embodiments will be described clearly and completely with reference to the accompanying drawings in the embodiments of the present disclosure. Apparently, the described embodiments are merely a portion rather than all of the embodiments of the present disclosure. All other embodiments made on the basis of the embodiments of the present disclosure by a person of ordinary skill in the art without paying any creative effort shall be included in the protection scope of the present disclosure.

In the description of the present disclosure, it should be understood that an azimuth or position relationship indicated by terms "center", "longitudinal", "transverse", "front", "rear", "left", "right", "vertical", "horizontal", "top", "bottom", "inner", "outer" and the like is an azimuth or position relationship based on the accompanying draws, which is only for facilitating description of the present disclosure and simplifying description, but not indicates or implies that the referred device or component must have a specific azimuth and perform construction and operation in the specific azimuth; therefore, it cannot be interpreted as a limitation to the protection scope of the present disclosure.

Some embodiments of the present disclosure provide an air conditioner pipeline and an air conditioner, thereby alleviating the problem of complicated installation of the air conditioner pipeline.

As shown in FIG. 1, some embodiments provide an air conditioner pipeline, including a pipe body 1, wherein a flow channel 2 for a refrigerant to flow is formed by an inner side of a pipe wall of the pipe body 1; the pipe wall of the pipe body 1 is provided with at least two conductive parts 3 and at least two insulating parts 4; the conductive parts 3 are configured to transmit power to the air conditioner; and the insulating parts 4 are configured to realize insulation between the conductive parts 3.

Length extending directions of the conductive parts 3 are consistent with a length extending direction of the pipe body 1. The insulating parts 4 are configured to realize insulation between the conductive parts 3. The insulating parts 4 are further configured to realize insulation at the periphery of the conductive parts 3. Optionally, length extending directions of the insulating parts 4 are consistent with the length extending direction of the pipe body 1.

In some embodiments, the inner side of the pipe wall of the pipe body 1 is used for refrigerant transmission, the pipe wall of the pipe body 1 is provided with conductive parts 3, the conductive parts 3 are configured to transmit power, and one air conditioner pipeline can transmit refrigerants and also can transmit power, thereby saving the connection cost of an indoor unit and an outdoor unit of the air conditioner, reducing the installation complexity of the air conditioner, achieving high safety and facilitating implementation.

The flow channel 2 in the inner side of the pipe wall of the pipe body 1 refers to an axial channel in the inner side of the annular pipe wall of the pipe body 1. The conductive parts 3 are arranged on a pipe wall body of the pipe body 1.

In some embodiments, the air conditioner pipeline further includes a partition plate 5 arranged on the inner side of the pipe wall of the pipe body 1 and configured to at least partition the flow channel 2 into a first flow channel 21 and a second flow channel 22, where the first flow channel 21 is configured to convey a liquid refrigerant, and the second flow channel 22 is configured to convey a gaseous refrigerant.

The partition plate 5 is made of a material with strong heat-insulating performance and divides the flow channel 2 into the first flow channel 21 and the second flow channel 22; the first flow channel 21 is configured to transmit a compressed liquid refrigerant; the second flow channel 22 is configured to transmit a gaseous refrigerant; and the gaseous refrigerant and the liquid refrigerant can be transmitted in one air conditioner pipeline, and two pipelines such as a gas pipe and a liquid pipe are not required, so that the engineering construction difficulty and the engineering construction investment are reduced.

In some embodiments, the conductive parts 3 are made of metal conductive materials, and the conductive parts 3 are configured as power transmission lines. The pipe wall of the pipe body 1 directly forms the conductive parts 3 as power transmission lines, thereby saving a large number of engineering cable costs, simplifying engineering construction and reducing construction cost.

The conductive parts 3 are made of metal conductive materials such as copper. During actual use, refrigerant transmission and electricity conducting functions can be implemented by directly using one pipeline that is made of the metal conductive materials and the insulating materials and is provided with the conductive parts 3 and the insulating parts 4, so that the engineering installation cost is saved. Power supply is realized through the pipe wall of the pipe body 1, so that direct-current power supply and alternating-current power supply can be realized.

Optionally, insulating layers are arranged on the inner side of each of the conductive parts 3, that is, one side adjacent to the interior of the pipe body 1, and the outer side of each of the conductive parts 3, that is, one side away from the interior of the pipe body 1. The adjacent conductive parts 3 are isolated through the insulating parts 4.

Or the refrigerant in the pipe body 1 adopts a refrigerant with insulativity, and the insulating layer is arranged on the outer side of each of the conductive parts 3, that is, one side away from the interior of the pipe body 1; and the insulating layer is not required to be arranged on the inner side of each of the conductive parts 3, that is, one side adjacent to the interior of the pipe body 1. Or the inner side of the pipe wall of the pipe body 1 is made of the metal conductive material, the pipe wall of the pipe body 1 is provided with at least two conductive parts 3 surrounding the central axis of the pipe body 1 at intervals, and the insulating parts 4 are arranged between the adjacent conductive parts 3.

In some embodiments, the conductive parts 3 include a first conductive part 31 and a second conductive part 32 surrounding a central axis of the pipe body 1 at intervals, an insulating part 4 is arranged between the first conductive part 31 and the second conductive part 32, the first conductive part 31 and the second conductive part 32 are made of metal conductive materials; and the first conductive part 31 is configured as a live wire, and the second conductive part 32 is configured as a neutral wire.

In some embodiments, the pipe wall of the pipe body 1 is further provided with a communication part 6, the communication part 6 and the conductive parts 3 surround the central axis of the pipe body 1 at intervals, insulating parts 4 are arranged between the communication part 6 and the conductive parts 3, the insulating parts 4 are further configured to realize insulation between the communication part 6 and the conductive parts 3, and the communication part 6 is configured to transmit a communication signal to the air conditioner.

A length extending direction of the communication part 6 is consistent with a length extending direction of the pipe body 1, and the insulating parts 4 are configured to realize insulation of the communication part 6.

By an air conditioner pipeline multiplexing technology, one air conditioner pipeline can transmit a refrigerant and also can transmit power and communication information, so that the connection cost of an indoor unit and an outdoor unit of the air conditioner is saved, the manufacturing process is simple and convenient, the cost is low, and implementation is facilitated.

In some embodiments, the communication part 6 is made of a metal conductive material, and the communication part 6 is configured as a communication transmission line to transmit a communication signal to the air conditioner. The pipe wall of the pipe body 1 directly forms a communication transmission line, thereby saving a large number of engineering cable costs, simplifying engineering construction and reducing construction cost.

In some embodiments, as shown in FIG. 1, in the cross-section schematic diagram of the air conditioner pipeline, the conductive parts 3 include a first conductive part 31 and a second conductive part 32, the pipe wall of the pipe body 1 is further provided with a communication part 6, the insulating parts 4 include a first insulating part 41, a second insulating part 42 and a third insulating part 43, the first insulating part 41 is arranged between the first conductive part 31 and the second conductive part 32, the second insulating part 42 is arranged between the first conductive part 31 and the communication part 6, and the third insulating part 43 is arranged between the second conductive part 32 and the communication part 6.

The annular pipe wall of the pipe body 1 is electrically isolated by three insulating parts such as the first insulating part 41, the second insulating part 42 and the third insulating part 43 to form two mutually isolated conductive parts 3 and one communication part 6. The first conductive part 31 and the second conductive part 32 are made of metal conductive materials and serve as power transmission lines to realize the power transmission of the air conditioner. For example: the first conductive part 31 and the second conductive part 32 can be used as a live wire and a neutral wire for alternating-current power supply, and also can realize high and low-voltage direct-current power supply. The communication part 6 is made of a metal conductive material and serves as a communication line for communicating with the air conditioner.

Optionally, the communication part 6 cooperates with the second conductive part 32 to realize the information transmission of communication. That is, the communication part 6 and the first conductive part 31 share the second conductive part 32.

Of course, the pipe wall of the pipe body 1 of the air conditioner pipeline is not limited to being provided with one communication part 6, two conductive parts 3 and three insulating parts 4, and three, four, five or more conductive parts 3, or two, three or more communication parts 6 may be provided according to requirements. Insulation between the conductive parts 3, between the communication parts 6, and between the conductive part 3 and the communication part 6 formed by the pipe wall of the pipe body 1 is realized through the insulating parts 4.

In some embodiments, the conductive parts 3 are integrally extruded by metal conductive materials, the insulating parts 4 are integrally extruded by insulating materials, and a flow channel for a refrigerant to flow and an electric lead may be directly formed by an integrated extrusion forming process, thereby facilitating the implementation of the structure.

In some embodiments, materials of the conductive parts 3 may be metal conductive materials such as copper.

Some embodiments provide an air conditioner, including the above air conditioner pipeline.

Optionally, the air conditioner pipeline serves as a connecting pipeline between an indoor unit and an outdoor unit of the air conditioner.

In the engineering installation process of the air conditioner, one air conditioner pipeline can be used to realize refrigerant transmission and realize power supply and/or communication. It is unnecessary to bind pipelines and cables together for engineering installation, so that the construction complexity is greatly simplified, and the engineering cost is saved.

Furthermore, the conductive parts and/or the communication part of the air conditioner pipeline are made of metal conductive materials and may directly serve as electric leads and/or communication lines, thereby saving a large number of engineering cable costs, simplifying engineering construction and reducing construction cost.

Based on the embodiments of the present disclosure, the technical features of one of the embodiments can be beneficially combined with one or more of other embodiments without explicit negation.

In the description of the present disclosure, it should be understood that the words "first", "second", "third" and the like for limiting parts are merely for convenience of distinguishing the parts. Unless otherwise stated, the above words do not have special meanings and cannot be construed as limitations to the protection scope of the present disclosure.

Finally, it should be noted that the above embodiments are merely intended to describe the technical solutions of the present disclosure and are not to limit them. Although the present disclosure has been described in detail with reference to the preferred embodiments, those of ordinary skill in the art should understand that modification can be made on the specific embodiments of the present disclosure and equivalent replacement can be made on part of the technical features; and the modification and the equivalent replacement should be covered within the protection scope of the technical solutions claimed by the present disclosure without departing from the spirit of the technical solutions of the present disclosure.

The invention claimed is:

1. An air conditioner pipeline, comprising a pipe body, wherein a flow channel for a refrigerant to flow is formed by an inner side of a pipe wall of the pipe body;

wherein the pipe wall of the pipe body is composed of at least two conductive parts and insulating parts;

wherein the at least two conductive parts are integrally formed as a part of the pipe wall, and inner surfaces of the at least two conductive parts define a portion of the flow channel;

wherein the at least two conductive parts and insulating parts together surround a central axis of the pipe body, and adjacent conductive parts are separated by the insulating parts;

wherein the conductive parts are made of metal conductive materials and are configured as power transmission lines to transmit power to the air conditioner; and the insulating parts are configured to electrically insulate adjacent conductive parts from each other.

2. The air conditioner pipeline according to claim 1, further comprising a partition plate arranged on the inner side of the pipe wall of the pipe body and configured to at least partition the flow channel for the refrigerant to flow into a first flow channel and a second flow channel, wherein the first flow channel is configured to convey a liquid refrigerant, and the second flow channel is configured to convey a gaseous refrigerant.

3. The air conditioner pipeline according to claim 1, wherein the conductive parts are made of metal conductive materials, and the conductive parts are configured as power transmission lines.

4. The air conditioner pipeline according to claim 1, wherein the at least two conductive parts comprise a first conductive part and a second conductive part which surround a central axis of the pipe body at intervals; the insulating parts are arranged between the first conductive part and the second conductive part; the first conductive part and the second conductive part are made of metal conductive materials; and the first conductive part is configured as a live wire, and the second conductive part is configured as a neutral wire.

5. The air conditioner pipeline according to claim 1, wherein the pipe wall of the pipe body is provided with a communication part; the communication part and the conductive parts surround the central axis of the pipe body at intervals; the insulating parts are further configured to realize insulation between the communication part and the conductive parts; and the communication part is configured as a communication transmission line to transmit a communication signal to the air conditioner.

6. The air conditioner pipeline according to claim 5, wherein the communication part is made of a metal conductive material, and the communication part is configured as a communication transmission line.

7. The air conditioner pipeline according to claim 1, wherein the conductive parts comprise the first conductive part and the second conductive part; the pipe wall of the pipe body is further provided with the communication part; the insulating parts comprise a first insulating part, a second insulating part and a third insulating part; the first insulating part is arranged between the first conductive part and the second conductive part; the second insulating part is arranged between the first conductive part and the communication part; and the third insulating part is arranged between the second conductive part and the communication part.

8. The air conditioner pipeline according to claim 1, wherein the conductive parts are integrally extruded by the metal conductive materials, and the insulating parts are integrally extruded by insulating materials.

9. The air conditioner pipeline according to claim 8, wherein materials of the conductive parts comprise copper.

10. The air conditioner pipeline according to claim 1, wherein length extending directions of the conductive parts and the insulating parts are consistent with a length extending direction of the pipe body.

11. An air conditioner, comprising the air conditioner pipeline according to claim 1.

* * * * *